US011737554B2

(12) United States Patent
Moore et al.

(10) Patent No.: US 11,737,554 B2
(45) Date of Patent: Aug. 29, 2023

(54) SIDE MOUNT TABLE LEG ASSEMBLY

(71) Applicant: Whitecap Industries, Inc., Piscataway, NJ (US)

(72) Inventors: Todd Moore, St. Paul, MN (US); Christopher E. Tomao, Robbinsville, NJ (US)

(73) Assignee: Whitecap Industries, Inc., Piscataway, NJ (US)

( * ) Notice: Subject to any disclaimer, the term of this patent is extended or adjusted under 35 U.S.C. 154(b) by 113 days.

(21) Appl. No.: 17/480,670

(22) Filed: Sep. 21, 2021

(65) Prior Publication Data

US 2023/0086318 A1 Mar. 23, 2023

(51) Int. Cl.
*A47B 9/16* (2006.01)
*A47B 5/04* (2006.01)

(52) U.S. Cl.
CPC ..... *A47B 9/16* (2013.01); *A47B 5/04* (2013.01); *A47B 2200/0042* (2013.01)

(58) Field of Classification Search
CPC ..... A47B 9/16; A47B 5/04; A47B 2200/0042; F16M 11/00
USPC ... 108/50.01, 50.02, 44, 134, 135, 138, 145, 108/152; 248/222.13, 223.41, 223.51, 248/225.11, 292.12, 276.1, 284.1, 184.1, 248/185.1, 122.1, 126; 403/103
See application file for complete search history.

(56) References Cited

U.S. PATENT DOCUMENTS 1,063,220 A * 6/1913 Seaman ..... F16M 11/12 248/278.1
3,069,543 A 12/1962 Sazavsky
3,427,667 A 2/1969 Ratcliff
4,672,898 A * 6/1987 Davidson ..... A47B 23/02 108/142
4,995,322 A 2/1991 Frederick
5,673,628 A * 10/1997 Boos ..... G06F 1/1632 108/138
5,727,478 A 3/1998 Rahn et al.
5,964,439 A * 10/1999 Johnson ..... A61G 5/10 248/278.1
6,209,835 B1 * 4/2001 Walrath ..... F16M 11/28 248/276.1
6,896,231 B1 * 5/2005 Sullivan, Sr. ..... F16M 13/02 248/278.1

(Continued)

FOREIGN PATENT DOCUMENTS

CN 110403359 * 11/2019
ES 2478390 * 12/2014
WO 9413362 * 6/1994

OTHER PUBLICATIONS

"Adjustable boat table pedestal S2000," https://www.nauticexpo.com/prod/forma-marine-furniture-llc/product-23594-193428.html, 5 pages, Retrieved May 13, 2021.

(Continued)

*Primary Examiner* — Janet M Wilkens
(74) *Attorney, Agent, or Firm* — Servilla Whitney LLC

(57) ABSTRACT

A side mount table leg assembly that is height adjustable to a plurality of heights is disclosed. The table leg assembly comprises an upper leg, a lower leg and a first and a second pivotable connection. The table leg assembly further comprises a side mount adapter configured to be slidably and removably engaged with a mounting bracket that is mountable to a non-horizontal surface.

15 Claims, 6 Drawing Sheets

(56) References Cited

U.S. PATENT DOCUMENTS

| | | | | |
|---|---|---|---|---|
| 7,367,740 | B2 * | 5/2008 | Lazic | F16M 11/12 403/103 |
| 8,973,878 | B2 * | 3/2015 | Thompson | A47G 1/175 403/348 |
| 9,140,406 | B2 * | 9/2015 | Simon | F16M 11/105 |
| 2002/0017495 | A1 * | 2/2002 | Iizuka | B01J 47/14 210/687 |
| 2007/0157856 | A1 | 7/2007 | Skoog et al. | |
| 2007/0164176 | A1 * | 7/2007 | Liao | F16M 13/02 248/176.3 |
| 2010/0259877 | A1 * | 10/2010 | Johnson | F16M 11/24 361/679.02 |
| 2014/0226281 | A1 * | 8/2014 | Emami | F16M 11/041 248/124.2 |
| 2020/0345132 | A1 | 11/2020 | White et al. | |

OTHER PUBLICATIONS

"Garelick Side Mount Coaming Table Leg System," https://www.iboats.com/shop/garelick-side-mount-coaming-table-leg-system.html, 3 pages, Retrieved Jul. 21, 2021.

"Height Adjustable Single Gas Spring Laptop Arm Mount Support 12-17.3 inch Laptop/Notebook," https://www.amazon.com/gp/product/B085DVG13T/ref=ox_sc_saved_title_1?smid=A3T8D68MUA8DQ1&psc=1, 5 pages, Retrieved Jul. 21, 2021.

"Removable Side Mount Table Support Arm," https://tacomarine.com/table-pedestals-removable-side-mount-table-pedestal-system-f16-0005a, 3 pages, Retrieved Jul. 21, 2021.

* cited by examiner

SIDE MOUNT TABLE LEG ASSEMBLY

TECHNICAL FIELD

The present disclosure relates generally to table leg assemblies, and in particular, table leg assemblies that can be side mounted and are height adjustable to a variety of heights.

BACKGROUND

In recreational vehicles such as boats and motorhomes, and in microhomes (homes less than 400 square feet), side mount tables can be used in a variety of locations. For example, in a recreational boat having a bow-riding area and/or a stern swim platform, side mount tables may be mounted to a non-horizontal surface, allowing users to use the table for dining, drinks or as a work surface. In larger boats, including larger bow rider boats, yachts, pontoon boats and party boats, it may be desirable to mount a side mount table in a mid-section area of the boat between the bow and the stern, such as a lounge area or dining area. In a motorhome or a microhome, where space is at a premium, such side mount tables can be mounted in a kitchen, a dining area, a front porch or a back deck.

Existing side mount table legs generally include a unitary angled table leg with a first end mounted to the table, and a second end that connects to a side mount bracket. An example of such a side mount table is the removable side mount table support arm available from Taco Marine of Miami, Fla. and available at (https://tacomarine.com/table-pedestals-removable-side-mount-table-pedestal-system-f16-0005a). Referring to FIGS. 1A and 1B, such an existing side mount table leg is shown as comprising a unitary leg 52 comprising a bend 54. A first end 52*a* of the unitary leg 50 is affixable to a table by a table mount 56, and a second end 52*b* of the unitary table leg 50 is mountable to a bracket 58, and a set screw 59 affixes the table leg second end 52*b* to the bracket to prevent the table leg 60 from inadvertently or accidentally disconnecting from or falling out of the bracket 58. For example, when the side mount table leg is mounted to a non-horizontal surface of a boat, when a boat is moving and encounters wake or waves, bouncing of the boat hull on the wake or waves could cause the table leg to dismount from the bracket 58.

While existing side mount table legs provide a way to mount a table to a non-horizontal surface, these existing designs have several disadvantages and limitations, and there remains a need for improved side mount table legs.

SUMMARY

One or more embodiments of the disclosure are directed to a side mount table leg assembly comprising a lower leg comprising a first pivotally connectable end, the first pivotally connectable end connected to a side mount adapter by a first pivotable connection, and a second pivotally connectable end connected by a second pivotable connection to a first pivotally connectable end of an upper leg, and a second end of the upper leg connectable to a bottom surface of a table; and a mounting bracket attachable to a non-horizontal surface, the side mount adapter configured to be slidably and removably engaged with the mounting bracket, the first pivotable connection and the second pivotable connection configured to permit the second end of the upper leg to be adjusted from a first, fully extended height, to a plurality of intermediate heights, and a lower height.

In another aspect, one or more embodiments are directed to a side mount table assembly comprising a leg assembly including a lower leg comprising a first pivotally connectable end, the first pivotally connectable end connected to a side mount adapter by a first pivotable connection, and a second pivotally connectable end connected by a second pivotable connection to a first pivotally connectable end of an upper leg, and a second end of the upper leg connected to a bottom surface of a table; and a mounting bracket attachable to a non-horizontal surface, the side mount adapter configured to be slidably and removably engaged with the mounting bracket, the first pivotable connection and the second pivotable connection configured to permit the second end of the upper leg to be adjusted from a first, fully extended height, to a plurality of intermediate heights, and a lower height.

Another aspect of the disclosure pertains to a method of using a table including a table leg assembly, the method comprising slidably engaging a side mount adapter connected to a first pivotally connectable end of a lower leg of the table leg assembly by a first pivotable connection with a side-mounted mounting bracket; and pivoting a second pivotable connection connecting a second pivotally connectable end of the lower leg to a first pivotally connectable end of an upper leg to adjust a height of the table connected to a second end of the upper leg to allow a user of the table to use the table as a coffee table, a dining table, a work table and a bar table.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Before describing several exemplary embodiments of the disclosure, it is to be understood that the disclosure is not limited to the details of construction or process steps set forth in the following description. The disclosure is capable of other embodiments and of being practiced or being carried out in various ways.

The term "horizontal" as used herein is defined as a plane parallel to the plane or surface of a floor, a deck or a deck of a boat, regardless of its orientation. The term "vertical" refers to a direction perpendicular to the horizontal as just defined. The term "non-horizontal" includes planes that are at 20 degrees to 120 degrees from a horizontal plan, including, but not limited to vertical. The phrases "side mount" and "side mounted" refer to a table leg that is affixed to a non-horizontal surface of a room, a deck, a vehicle, a boat or a motorhome. For example, a side mounted or side mount table leg assembly is not affixed to the deck or gunwale of a boat, but instead is affixed to a sidewall surface of a boat such as a wall, a coaming or other non-horizontal surface. Terms, such as "above", "below", "bottom", "top", "side" (as in "sidewall"), "higher", "lower", "upper", "over", and "under", are defined with respect to the horizontal surface as shown in the figures.

The term "on" indicates that there is direct contact between elements. The term "directly on" indicates that there is direct contact between elements with no intervening elements.

Figure 1A:
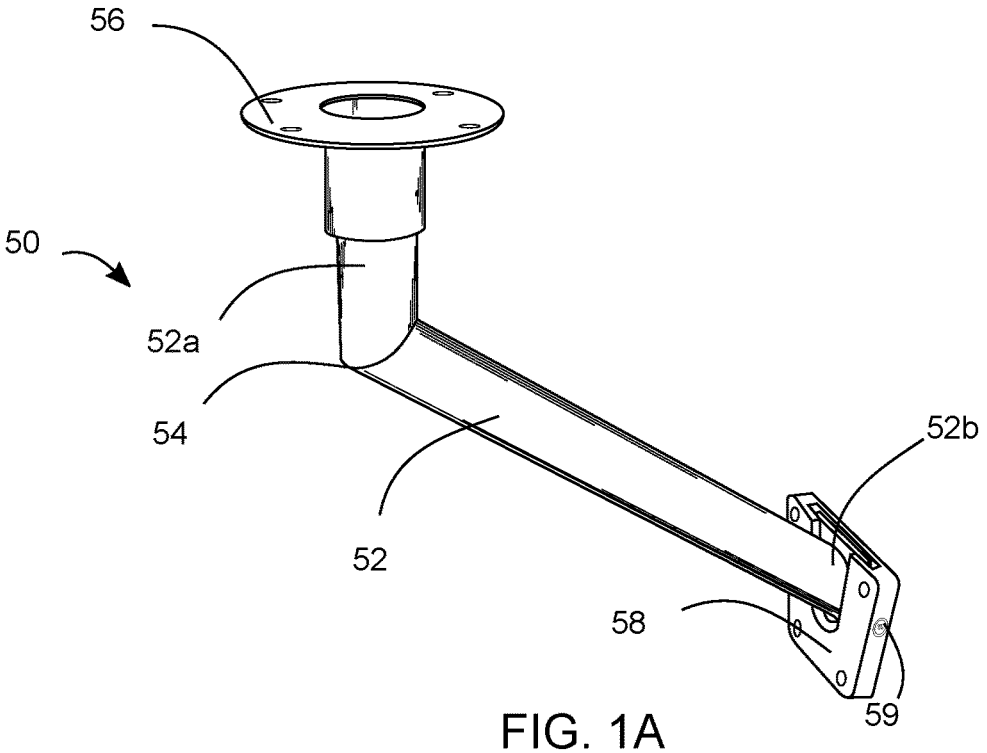
FIG. 1A Prior Art
FIG. 1A is a side isometric view of a prior art side mount table assembly.
Figure 1B:
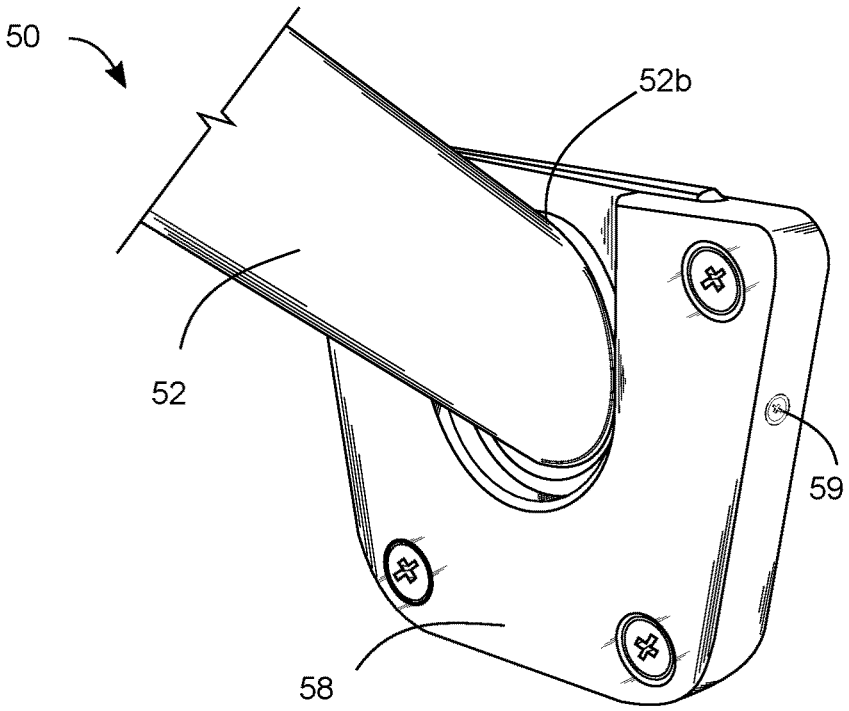
FIG. 1B Prior Art
FIG. 1B an enlarged side isometric view of a portion of the prior art side mount table assembly shown in FIG. 1A.

Existing side mount table legs have several limitations and disadvantages. Referring to FIG. 1A and FIG. 1B, the existing side mount table leg requires a set screw and tools to mount and unmount the table leg from the bracket. This causes mounting and dismounting to be complicated and difficult. In addition, when the table leg is not in use, the single piece or unitary design of the table leg 50 is bulky, making the table leg difficult to stow or store when a user of the table is not using the table and desires more space. Furthermore, the height of the table is not readily adjustable to a variety of heights that may be needed or desired, depending on the height of the user and the particular desired use of the table. For example, it may be desirable to use the table as a coffee table, a worktable, a dining table or a bar table, and each of these uses requires a different height of the tabletop. With the existing design, only a single height is possible once that table leg is mounted to the bracket. If multiple height configurations are desired or needed, multiple table legs would need to be purchases or multiple brackets mounted at different heights. This would require a user of the table leg to drill holes and mount brackets in multiple locations at multiple heights of non-horizontal surfaces.

Embodiments of the disclosure provide a side mount table leg assembly that is fully adjustable in height and to a variety of horizontal and vertical positions. One or more embodiments provides a table leg assembly that also is configured to provide a tilted table with respect to a horizontal standing surface. According to one or more embodiments, a single table leg assembly can be used in a variety of locations and for a variety of functions in a micro home (a home that it less than 400 square feet in living area) or on a vehicle such as a motor home, a conversion van, or a boat. The table leg assembly is configurable for multiple uses and multiple heights, according to a user's needs. In addition, because the table leg assembly comprises two separate connected legs, the table leg assembly is configured to be folded and easily stowed and stored when the table is not in use or desired to be deployed. In one or more embodiments, a locking pin is configured to allow the table leg to be readily mounted and dismounted from a side mount bracket. The locking pin, which can be spring-loaded engages a receiving slot in the side mount bracket, enabling a user to mount or dismount the table using a single hand.

Referring now to FIGS. 2-7A-D, embodiments of the disclosure pertain to a side mount table leg assembly 100 as shown in FIGS. 2-6A-B and a side mount table assembly including the side mount table assembly shown in FIGS. 7A-D.

Figure 7A:
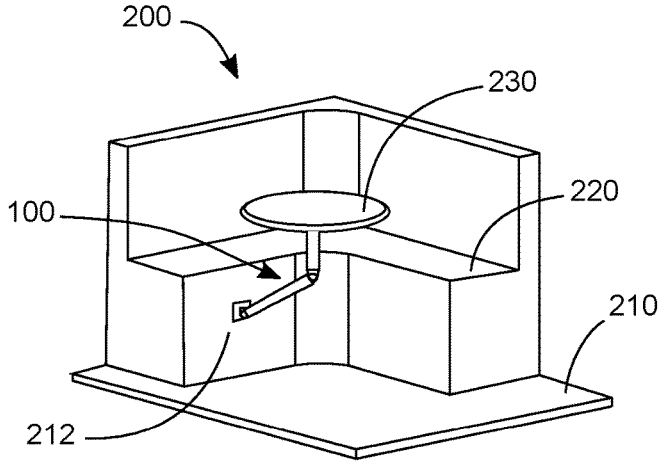
FIG. 7A is an isometric view of a side mount table leg assembly with a table and the table leg assembly mounted to a non-horizontal surface and the table positioned at a dining height.
Figure 7B:
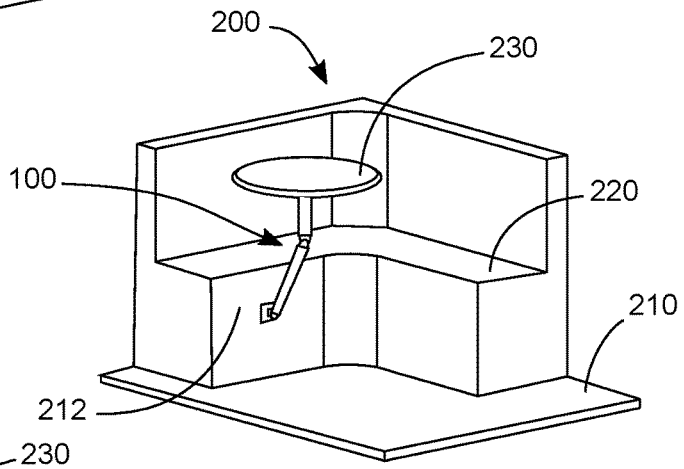
FIG. 7B is an isometric view of a side mount table leg assembly with a table and the table leg assembly mounted to a non-horizontal surface and the table positioned at a bar height or standing height.

Referring now to FIGS. 2-6A-B, an exemplary embodiment of a side mount table leg assembly 100 is shown as comprising a lower leg 102 comprising a first pivotally connectable end 102*a*, the first pivotally connectable end 102*a* connected as shown in FIGS. 3A-B and 4A-B to a side mount adapter 106 by a first pivotable connection 113*a*. The lower leg 102 further comprises a second pivotally connectable end 102*b* connected by a second pivotable connection 113*b* to a first pivotally connectable end 104*a* of an upper leg 104. A second end 104*b* of the upper leg 104 is connectable to a bottom surface 232 of a table 230 (as shown in FIG. 7D). The side mount table leg assembly 100 further comprises a mounting bracket 150 (shown in FIG. 5) attachable to a non-horizontal surface. In the embodiment shown, the side mount adapter 106 is configured to be slidably and removably engaged with the mounting bracket 150. The first pivotable connection 113*a* and the second pivotable connection 113B are configured to permit the second end 104*b* of the upper leg 104 to be adjusted from a first, fully extended height (as shown in FIG. 7B), to a plurality of intermediate heights (shown in FIGS. 7A-D), and a lower height (shown in FIG. 7C). When the second end 104*b* of the upper leg is attached to a table 230 as shown in FIGS. 7A-D, the table leg assembly is configured to deploy a table assembly in a variety of heights and configurations.

Figure 7C:
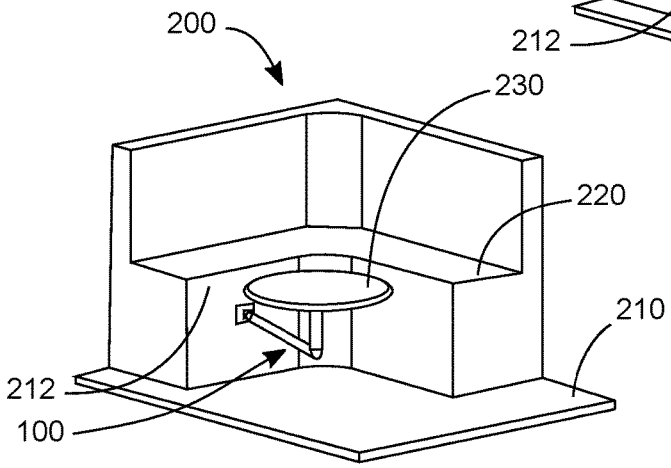
FIG. 7C is an isometric view of a side mount table leg assembly with a table and the table leg assembly mounted to a non-horizontal surface and the table positioned at a coffee table height.
Figure 7D:
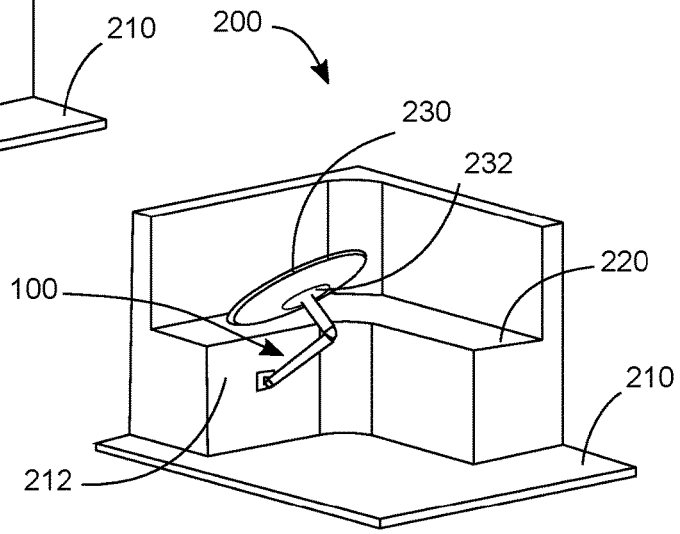
FIG. 7D is an isometric view of a side mount table leg assembly with a table and the table leg assembly mounted to a non-horizontal surface and the table positioned at a work-table height and the table positioned at an angle with respect to the horizontal standing surface.

In some embodiments, the side mount table leg assembly 100 at the lower height as shown in FIG. 7C, the second end 104*b* of the upper leg 104 is at a distance in a range of from about 14 inches to about 22 inches from a horizontal standing surface 210. In FIGS. 7A-D, the horizontal standing surface 210 is the deck of boat that passengers of the boat stand on. As shown in FIG. 7A and FIG. 7D, at the plurality of intermediate heights the second end 104B of the upper leg 104 is at a distance in a range of from greater than 22 inches and less than 40 inches from the horizontal standing surface 210. As shown in FIG. 7C, at the first fully extended height, the second end 104B of the upper leg 104 is at a distance in a range of from greater than 40 inches and less than 50 inches from the horizontal standing surface 210.

In non-limiting embodiments, as shown in FIG. the lower leg 102 has a length L1 that is longer than a length L2 of the upper leg 104. In non-limiting embodiments, the lower leg 102 has a length L1 in a range of from 10 inches to 48 inches, 12-40 inches 13-30 inches, or 14-20 inches and the upper leg 104 has a length L2 in a range of from 2 inches to 24 inches, 3-20 inches, 4-18 inches, 5-15 inches or 6-12 inches.

In one or more embodiments, the side mount table leg assembly 100, each of the first pivotable connection 113*a* and the second pivotable connection 113 comprises a rotatable knob 108*a*, 108*b* configured to loosen the respective first pivotable connection 113*a* and the second pivotable connection 113*b* to allow the side mount table leg to be raised and lowered. In one or more embodiments, the each of the rotatable knobs 108*a*, 108*b* of the first pivotable connection 113*a* and the second pivotable connection 113*b* are configured to rotatably adjust an angular position of the upper leg 104 and the lower leg 102 in one degree increments.

Figure 2:
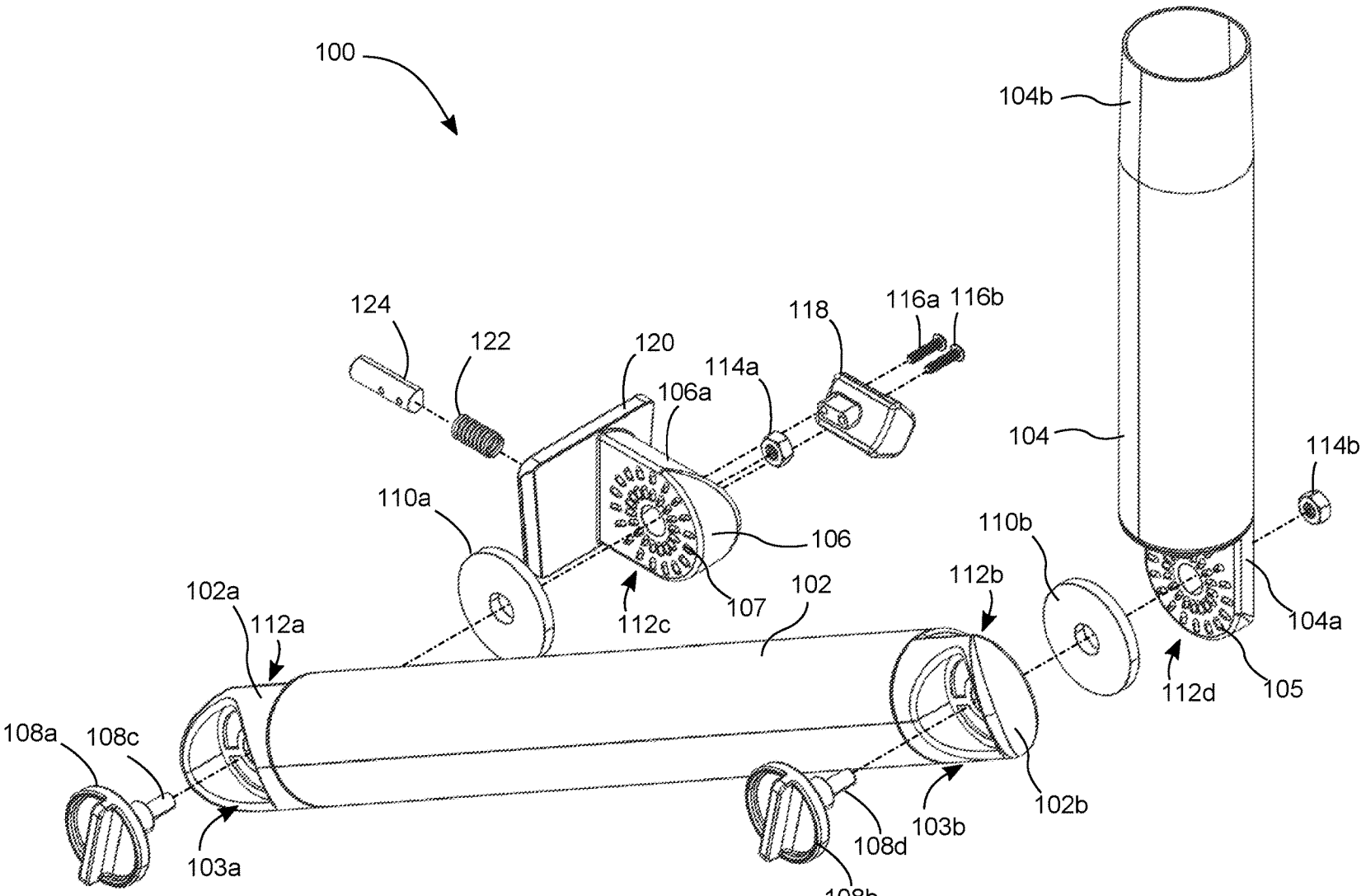
FIG. 2 is an exploded isometric view of a side mount table leg assembly according to an embodiment of the disclosure.
Figures 3A, 3B, 4A, 4B:
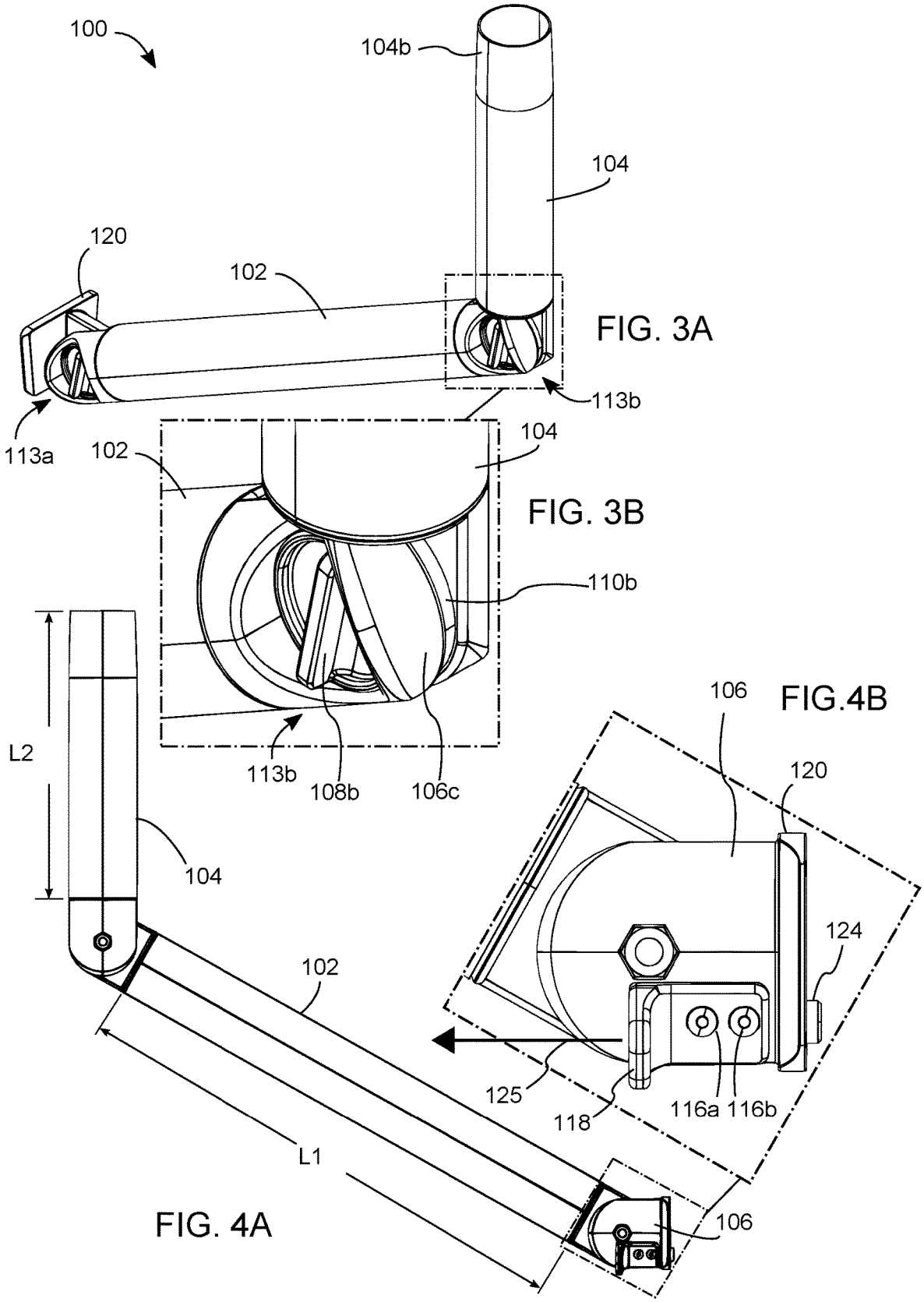
FIG. 3A is a side perspective view of the side mount table leg assembly shown in FIG. 1A in an assembled configuration.
FIG. 3B is an enlarged side isometric view of a portion of the side mount table leg assembly shown in FIG. 3A.
FIG. 4A is a side view of the opposite side of the side mount table leg assembly shown in FIG. 3A.
FIG. 4B is an enlarged side view of a portion of the side mount table mount assembly shown in FIG. 4A.

In one or more embodiments, the first pivotable connection 113*a* comprising the side mount adapter 106 includes a mounting leg 106*a* including a first face 112*c* engageable with a face 112*a* of the first pivotally connectable end 102*a* of the lower leg 102. As shown in FIG. 2, the first face 112*c* comprises a plurality of ribs 107 arranged in a coaxial radial pattern on the first face 112*c* of the mounting leg 106*a* of the side mount adapter. In the embodiment shown, the plurality of ribs 107 are arranged as two concentric circles, however, this arrangement is not limiting. As will be understood from the disclosure, the number and arrangement of the ribs 107 can be provided that is configured to allow incremental angular adjustment of the position of the lower leg 102 with respect to a non-horizontal or a horizontal surface. While not shown in the Figures, in some embodiments, the face 112*a* of the first pivotally connectable end 102*a* of the lower leg 102 can also comprise a plurality of ribs in a similar arrangement to the ribs 107 on the first face 112*c* on the side mount adapter.

Still referring to FIG. 2, in one or more embodiments, the second pivotable connection 113*b* comprises the second pivotally connectable end 102*b* of the lower leg 102 which includes a second face 112*b* engageable with a face 112*d* of the first pivotally connectable end 104*a* of the upper leg 104.

Figure 5:
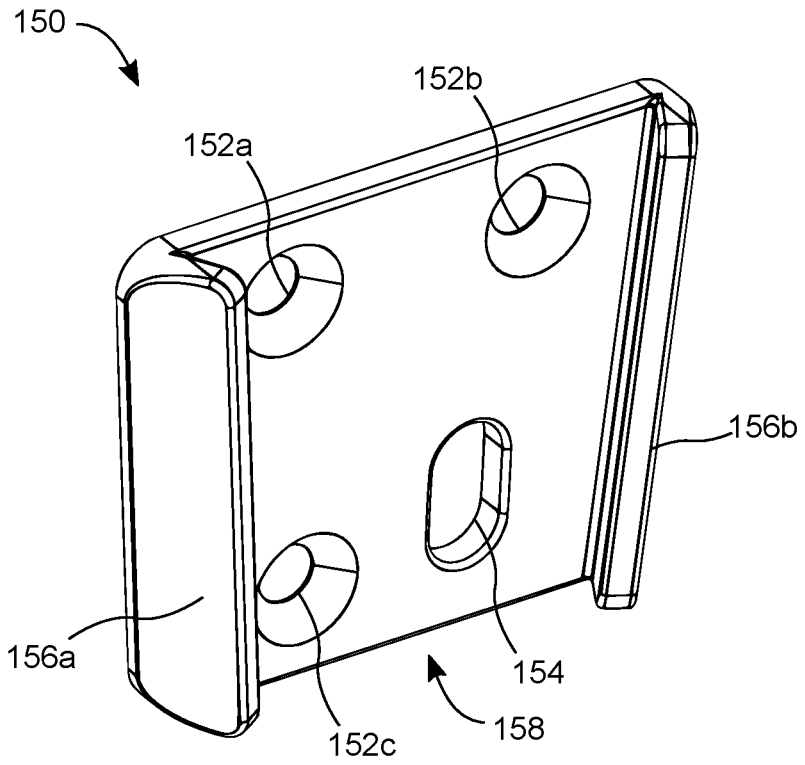
FIG. 5 is a side isometric view of a mounting bracket for a side mount table leg assembly according to an embodiment of the disclosure.
Figure 6A:
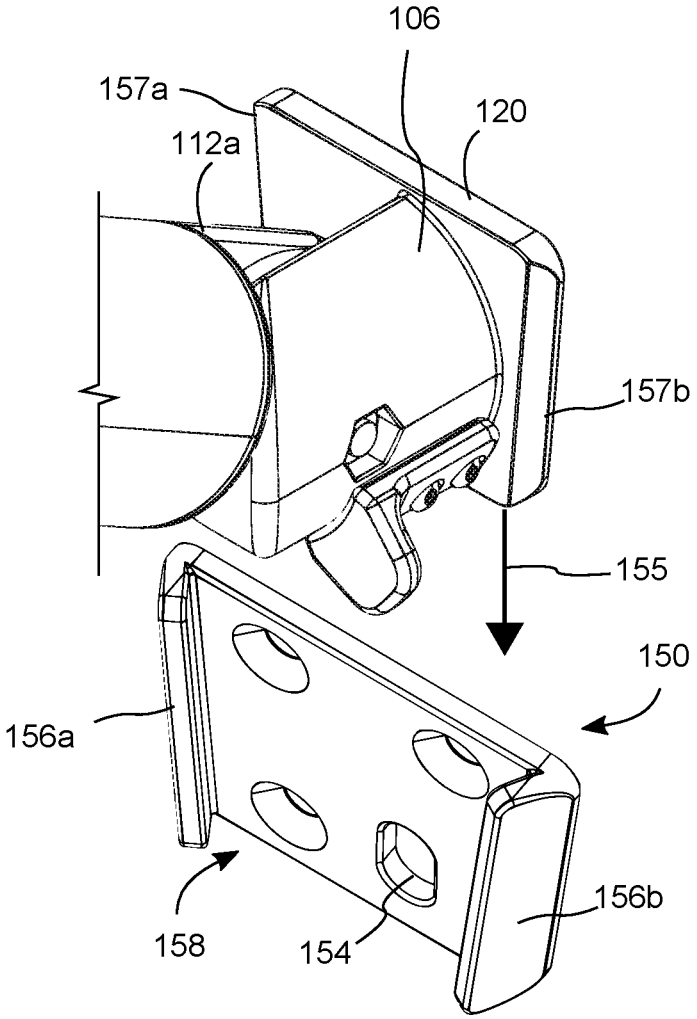
FIG. 6A is a side isometric view showing the side mount adapter of the side mount table let assembly in a position to be mounted to a mounting bracket.
Figure 6B:
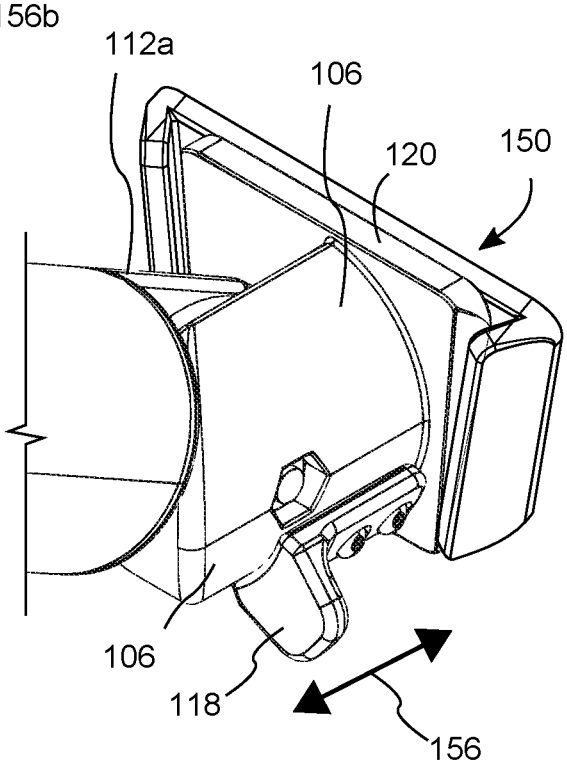
FIG. 6B is a side isometric view showing the side mount adapter of the side mount table let assembly shown in FIG. 6A mounted to a mounting bracket.

In one or more embodiments, the side mount adapter 106 comprising an angled plate 120 configured to be slidably engaged with an angled receiving pocket 158 extending from the mounting bracket 150. As best shown in FIG. 5, the mounting bracket 150, which is mountable to a non-horizontal surface, includes a first angled rail 156*a* and a second angled rail 156*b* spaced apart to provide the angled receiving pocket 158. In the embodiment shown, the angled receiving pocket 158 is in the shape of a trapezoid, with the first angled rail 156*a* and the second angled rail 156*b* defining non-parallel legs of the trapezoid. The angled plate 120 of the side mount adapter 106 also has the shape of a trapezoid that is complementary in shape to the shape of the angled receiving pocket 158. The angled plate 120 also comprises a first beveled edge 157*a* and a second beveled edge 157*b* that slidably engage first angled rail 156*a* and the second angled rail 156*b* defining the receiving pocket 158.

The mounting bracket 150 further includes mounting apertures 152*a*, 152*b*, and 152*c* that are sized, shaped and configured to receive fasteners, for example, screws or bolts that are used to affix the mounting bracket 150 to a non-horizontal surface 212, such as a wall, a coaming or a non-horizontal surface 212 extending from the deck of a boat, as shown in FIGS. 7A-D. In one or more embodiments, the apertures 152*a*, 152*b* and 152*c* are circular in shape.

In one or more embodiments, the first pivotable connection 113*a* further comprises a first friction washer 110*a* between the first face 112*c* of the mounting leg 106*a* and the face 112*a* of the first pivotally connectable end 102*a* of the lower leg 102. The second pivotable connection 113*b* further comprises a second friction washer 110*b* between the second face 112*b* of the second pivotally connectable end 102*b* of the lower leg 102 and the face 112*d* of first pivotally connectable end 104*a* of the upper leg 104. While not shown in the drawings, the face 112*a* and the second face 112*b* of some embodiments, each includes ribs similar to the ribs 107 and ribs 105. The ribs of the face 112*a* and the second face 112*b* can be in the same pattern as the ribs 107 and the ribs 105.

In one or more embodiments. the first friction washer 110*a* and the second friction washer 110*b* each comprise a polymer, for example, rubber, which can be a natural rubber or a synthetic rubber, for example, neoprene. In one or more embodiments, the first friction washer 110*a* and the second friction washer 0 each have a hardness in a range of from about 60 to about 100 shore durometer, for example 70-90 shore durometer. With reference to FIG. 2, the rotatable knob 108*a* includes a threaded end 108, and the rotatable knob 108*b* includes a threaded end 108*d*. The threaded end 108*c* is inserted through an aperture in the first pivotally connectable end 102*a* of the lower leg, the first friction washer 110*a* and an aperture in the mounting leg 106*a*, which threadably engages a first nut 114*a*. Similarly, the threaded end 108*d* of the rotatable knob 108*b* is inserted through an aperture in the second pivotally connectable end 102*b* of the lower leg 102, the second friction washer 110*b* and an aperture in the first pivotally connectable end 104*a* of the upper end, which threadably engages a second nut 114*b*. Once the respective threaded ends 108*c*, 108*d* and the first nut 114*a* and the second nut 114*b* are threadably engaged, the respective rotatable knobs 108*a* and 108*b* can be tightened by rotating the respective rotatable knobs 108*a*, 108*b* in a manner to apply a force that sandwiches the respective first friction washer 110*a* and second friction washer 110*b* to hold the respective pivotable connections 113*a* and 113*b* so that the angle of the lower leg 102 and the upper leg 104 can be adjusted. It will be appreciated that the ribs 105, 107 and the friction washer 110*b* and 110*a* cooperate to hold the legs 102, 104 in a variety of angular positions so that the table can be raised and lowered as desired by a user of the table leg assembly 100. In one or more embodiments, the first pivotable connection 113*a* and second pivotable connection 113*b* each do not include a worm gear or gas shock springs.

In one or more embodiments, the second end 104*b* of the upper leg 104 is connectable to a bottom surface of a table by a friction fitting, for example, by sliding the second end 104*b* into a table mount such as the table mount 56 shown in FIG. 1 or any suitable table mount. Referring to FIG. 2, FIG. 3A, FIG. 3B and FIGS. 6A-B, the side mount adapter 106 includes a slidable locking pin 124 that is biased to engage a locking slot 154 in the mounting bracket 150. The locking slot 154 is elongate and in the shape of an oval. The slidable locking pin 152 is biased by a biasing spring 122 which urges the slidable locking pin 124 towards the locking slot. The slidable locking pin 152 of some embodiments is mounted to a pull lever 118, which can be fastened to the slidable locking pin by threaded fasteners 116*a*, 116*b* that engage threaded apertures in the slidable locking pin 124.

The slidable locking pin 124 is configured to allow a user to mount and dismount the lower leg 102 and remove the table leg assembly 100 from the mounting bracket 150 without tools. In one or more embodiments, the upper leg 104 may also be mounted and dismounted from the table by a similar slidable locking pin arrangement as the locking pin 124 shown and described here.

It will be appreciated that the table leg assembly 100 is configured to be folded at the second pivotable 113*b* connection to facilitate storage of the table leg assembly. In use, a user of the table leg assembly slidably moves the angled plate 120 in the direction of arrow 155 shown in FIG. 6A to engage the angled plate 120 with the mounting bracket 150. The lower leg 102 is attached to the side mount adapter by the first pivotable connection 113*a*, and the lower leg 102 is attached to the second pivotable connection 113*b*. By loosening the rotatable knobs 108*a* and 108*b*, the table leg assembly can be adjusted to a nearly infinite number of heights and positions, several of which are shown in FIGS. 7A-D. Once the angled plate 120 is engaged with the mounting bracket, a user can engage the slidable locking pin 124 by sliding the pull lever 118 away from the mounting bracket and then releasing the pull lever 118 (shown by arrow 156 in FIG. 6B) to allow the slidable locking pin 124 which is biased by the biasing spring to engage the locking slot 154 of the mounting bracket 150. To remove the table, a user can simply pull the pull lever 118 away from the mounting bracket 150, causing the slidable locking pin 124 to disengage from the locking slot 154, and allowing a user to lift the table assembly 200 out of the mounting bracket.

Storage and stowage of the table leg assembly 100 requires much less space than existing table leg assemblies. This is because a user can fold the upper leg 104 and the lower leg 102 towards each other, and the table leg assembly 100 can be stored in a small space such as a cabinet or a bin on a recreational vehicle or a boat. The ease of removal of the table leg assembly 100 from the mounting bracket 150 allows the table leg assembly 100 to be moved to a variety of locations. A user can purchase additional mounting brackets 150, and mount the brackets in various locations in a boat, permitting the user to have a versatile table that could be used in a dining area, on a swimming deck in a workspace or in the bow area of a boat. Raising and lower of the table is simple, convenient and fast, facilitated by the pivotable connections 113*a* and 113*b* including the rotatable knobs 108*a*, 108*b*, the friction washers 110*a*, 110*b* and the nuts 114*a*, 114*b*. A user can not only mount and dismount the table assembly 200 and table leg assembly 100 without using any tools, and the user also can adjust the height to a variety of heights to provide a variety of uses without any tools.

Another aspect of the disclosure pertains to method of using a table assembly, for example, the table assembly 200 shown in FIGS. 7A-D. In one or more embodiments, the table assembly 200 includes a table leg assembly 100. In specific embodiments, the table assembly comprises a single table 230 and a single table leg assembly 100 mounted to the table 230, and there is only one table leg assembly 100. The method comprises in one or more embodiments slidably engaging the side mount adapter 106 connected to the first pivotally connectable end 103*a* of the lower leg 102 of the table leg assembly 100 by the first pivotable connection 113*a* with mounting bracket 150. The method further comprises pivoting the second pivotable connection 113*b* connecting the second pivotally connectable end 102*b* of the lower leg 102 to the first pivotally connectable end 104*a* of the upper leg 104 to adjust a height of the table 230 connected to a second end 104*b* of the upper leg to allow a user of the table assembly 200 to use the table 230 as a coffee table, a dining table, a worktable and a bar table, as shown in FIGS. 7A-D.

The method of some embodiments further comprises adjusting an angular position of one or more the first pivotable connection 113*a* and the second pivotable connection 113*b* to adjust the height and angle of the table 230.

Some embodiments further comprise mounting the table assembly 200 to a mounting bracket 150 by sliding an angled plate 120 configured to be slidably engaged with the angled receiving pocket 168 extending from the mounting bracket 150 and slidably engaging the locking pin 124 with the mounting bracket 150.

Although embodiments of the present disclosure have been described in detail hereinabove in connection with certain exemplary embodiments, it should be understood that the disclosure is not limited to the disclosed exemplary embodiments, but is intended to cover various modifications and/or equivalent arrangements included within the spirit and scope of the present disclosure.

Reference throughout this specification to "one embodiment," "certain embodiments," "one or more embodiments" or "an embodiment" means that a particular feature, structure, material, or characteristic described in connection with the embodiment is included in at least one embodiment of the disclosure. Thus, the appearances of the phrases such as "in one or more embodiments," "in certain embodiments," "in one embodiment" or "in an embodiment" in various places throughout this specification are not necessarily referring to the same embodiment of the disclosure. Furthermore, the particular features, structures, materials, or characteristics may be combined in any suitable manner in one or more embodiments.

Although the disclosure herein has been described with reference to particular embodiments, it is to be understood that these embodiments are merely illustrative of the principles and applications of the present disclosure. It will be apparent to those skilled in the art that various modifications and variations can be made to the method and apparatus of the present disclosure without departing from the spirit and scope of the disclosure. Thus, it is intended that the present disclosure include modifications and variations that are within the scope of the appended claims and their equivalents.

What is claimed is:

1. A side mount table leg assembly comprising:

a lower leg comprising a first pivotally connectable end, the first pivotally connectable end connected to a side mount adapter by a first pivotable connection, and a second pivotally connectable end connected by a second pivotable connection to a first pivotally connectable end of an upper leg, and a second end of the upper leg connected to a bottom surface of a table;

a mounting bracket including an angled receiving pocket having a trapezoidal shape extending from the mounting bracket and having a first angled rail and a second angled rail defining non-parallel legs of a trapezoid, the mounting bracket attachable to a non-horizontal surface, the side mount adapter comprising an angled plate including a first beveled edge and a second beveled edge configured to be slidably and removably engaged with the first angled rail and the second angled rail of the angled receiving pocket; and the side mount adapter further comprising a slidable locking pin biased and configured to slidably engage with the mounting bracket and to lock the side mount leg table assembly to the mounting bracket, the slidable locking pin configured to allow a user to mount and dismount the side mount table leg assembly from mounting bracket with a single hand and without tools, wherein the first pivotable connection and the second pivotable connection are configured to permit the table to be adjusted from a first, fully extended height, to a plurality of intermediate heights, and a lower height to allow use of the table as a coffee table, a dining room table, a worktable and a bar table.

2. The side mount table leg assembly of claim 1, wherein at the lower height, the second end of the upper leg is at a distance in a range of from about 14 inches to about 22 inches from a horizontal standing surface, at the plurality of intermediate heights the second end of the upper leg is at a distance in a range of from greater than 22 inches and less than 40 inches from the horizontal standing surface, and at the first fully extended height, the second end of the upper leg is at a distance in a range of from greater than 40 inches and less than 50 inches from the horizontal standing surface.

3. The side mount table leg assembly of claim 2, wherein the lower leg has a length in a range of from 10 inches to 48 inches and the upper leg has a length in a range of from 2 inches to 36 inches.

4. The side mount table leg assembly of claim 1, wherein the lower leg has a length that is longer than a length of the upper leg.

5. The side mount table leg assembly of claim 1, wherein each of the first pivotable connection and the second pivotable connection comprises a rotatable knob configured to loosen the first pivotable connection and the second pivotable connection to allow the side mount table leg assembly to be raised and lowered.

6. The side mount table leg assembly of claim 5, wherein the each of the rotatable knobs of the first pivotable connection and the second pivotable connection is configured to rotatably adjust an angular position of the upper leg and the lower leg in one degree increments.

7. The side mount table leg assembly of claim 6, wherein the second pivotable connection comprises the second pivotally connectable end of the lower leg which includes a first face and a second face engageable with a face of the first pivotally connectable end of the upper leg.

8. The side mount table leg assembly of claim 7, wherein the first pivotable connection further comprises a first friction washer between the first face of the mounting leg and the face of the first pivotally connectable end of the lower leg, and the second pivotable connection further comprises a second friction washer between the second face of the second pivotally connectable end of the lower leg and the face of first pivotally connectable end of the upper leg.

9. The side mount table leg assembly of claim 8, wherein the first friction washer and the second friction washer each comprise a polymer.

10. The side mount table leg assembly of claim 9, wherein the polymer comprises rubber.

11. The side mount table leg assembly of claim 10, wherein rubber has a hardness in a range of from about 60 to about 100 shore durometer.

12. The side mount table leg assembly of claim 6, wherein the table leg assembly is configured to be folded at the second pivotable connection to facilitate storage of the table leg assembly.

13. The side mount table leg assembly of claim 1, wherein the first pivotable connection and second pivotable connection each do not include a worm gear or gas shock springs.

14. The side mount table leg assembly of claim 1, wherein the second end of the upper leg is connected to the bottom surface of the table by a friction fitting.

15. A method of using a table assembly including a table leg assembly, the method comprising:

slidably engaging an angled plate of a side mount adapter connected to a first pivotally connectable end of a lower leg of the table leg assembly by a first pivotable connection with an angled receiving pocket extending from a mounting bracket and slidably engaging a locking pin with the mounting bracket, the mounting bracket including an angled receiving pocket having a trapezoidal shape extending from the mounting bracket and having a first angled rail and a second angled rail defining non-parallel legs of a trapezoid, the mounting bracket and the side mount adapter comprising an angled plate including a first beveled edge and a second beveled edge configured to be slidably and removably engaged with the first angled rail and the second angled rail of the angled receiving pocket and biased and configured to slidably engage with the mounting bracket and to lock the table leg assembly to the mounting bracket, and the locking pin configured to allow a user to mount and dismount the table leg assembly from mounting bracket with a single hand and without tools; and connecting a bottom surface of a table to a second end of an upper leg; and adjusting an angular position of one or more the first pivotable connection and a second pivotable connection connecting a second pivotally connectable end of the lower leg to a first pivotally connectable end of the upper leg to adjust a height and angle of the table to allow a user of the table assembly to use the table as a coffee table, a dining table, a worktable and a bar table.

* * * * *